US011642557B2

(12) United States Patent
Koiwa

(10) Patent No.: US 11,642,557 B2
(45) Date of Patent: May 9, 2023

(54) SPRINKLER HEAD ACCESSORY

(71) Applicant: SENJU SPRINKLER CO., LTD., Tokyo (JP)

(72) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 57 days.

(21) Appl. No.: 17/225,648

(22) Filed: Apr. 8, 2021

(65) Prior Publication Data

US 2021/0322811 A1 Oct. 21, 2021

(30) Foreign Application Priority Data

Apr. 16, 2020 (JP) ..... JP2020-073220

(51) Int. Cl.

| | |
|---|---|
| ***A62C 35/68*** | (2006.01) |
| ***B05B 15/65*** | (2018.01) |
| ***F24F 7/00*** | (2021.01) |
| ***A62C 31/28*** | (2006.01) |

(52) U.S. Cl.

CPC ..... *A62C 35/68* (2013.01); *A62C 31/28* (2013.01); *B05B 15/65* (2018.02); *F24F 7/00* (2013.01)

(58) Field of Classification Search

CPC ..... A62C 35/68; A62C 31/28; B05B 15/65; F24F 7/00

USPC ..... 169/37

See application file for complete search history.

(56) References Cited

U.S. PATENT DOCUMENTS

| | | | | |
|---|---|---|---|---|
| 5,447,338 | A | 9/1995 | Kikuchi | |
| 6,484,809 | B1 * | 11/2002 | Elder | A62C 31/28 169/57 |
| 7,185,567 | B2 | 3/2007 | Ide | |
| 8,376,060 | B2 | 2/2013 | Orr et al. | |
| 9,616,450 | B2 | 4/2017 | Connery et al. | |

* cited by examiner

*Primary Examiner* — Christopher S Kim

(74) *Attorney, Agent, or Firm* — Cermak Nakajima & McGowan LLP; Tomoko Nakajima

(57) ABSTRACT

A sprinkler head accessory includes an inner ring attached to a sprinkler head and an outer ring hiding the edge of a ceiling hole through which the sprinkler head passes. The inner ring has a partition portion facing the outer ring with a gap therebetween. A ventilation portion constituted by the gap through which the indoor side of a ceiling board and the back side of the ceiling board communicate with one another is provided between the outer ring and the partition portion.

15 Claims, 9 Drawing Sheets

SPRINKLER HEAD ACCESSORY

BACKGROUND OF THE INVENTION

1. Field of the Invention

The present invention relates to an accessory of a sprinkler head installed in a building.

2. Description of the Related Art

Sprinkler systems are installed in buildings. Upon detecting heat of a fire, such a sprinkler system operates automatically and sprinkles water to extinguish the fire. A nozzle provided in a sprinkler head is connected to a pipe connected to a water supply source. In normal times, the nozzle is in a closed state by a valve, which is supported by a heat-activated unit, being closed. If a fire breaks out, in response to the heat, the heat-activated unit operates to release the valve in the closed state, and the water filled in the pipe is discharged through the nozzle. The sprinkler head has, on an extension of an outlet of the nozzle, a deflector that scatters water in all directions. The water that has collided with the deflector is sprinkled over a predetermined range, thereby suppressing and extinguishing the fire.

In the sprinkler head installed in a room, the pipe is hidden by a ceiling board whereas the sprinkler head passes through the ceiling board and the deflector is disposed on the indoor side. Thus, the ceiling board has a through hole for installing the sprinkler head in a state of passing through the ceiling board. To hide the through hole, the sprinkler head has accessories such as a ceiling plate and an escutcheon (for example, refer to FIG. 5 of U.S. Pat. No. 7,185,567).

As FIG. 6 illustrates, an outer ring 62 and an inner ring 64 that is attached to a sprinkler head 63 are provided to hide a through hole H of a ceiling board C into which the sprinkler head 63 is inserted. The outer ring 62 has a dish portion 61 having a diameter larger than that of the through hole H. The outer ring 62 hides the through hole H of the ceiling board C in a manner such that a tube portion 65 extending from the inner edge of the dish portion 61 to the back side of the ceiling is fitted onto the inner ring 64.

When an operation of the above-described sprinkler head is attempted to be facilitated, the design thereof is deteriorated, and it thereby tends to be difficult to achieve both.

SUMMARY OF THE INVENTION

Thus, the present invention aims to facilitate a swift operation of a sprinkler head while the design of a sprinkler system is considered.

An aspect of the present invention is an accessory to be provided on a sprinkler head. The sprinkler head accessory includes an inner ring attached to the sprinkler head and an outer ring hiding the edge of a hole of a ceiling board through which the sprinkler head passes. The inner ring has an opposing wall portion facing the outer ring with a gap therebetween. A ventilation portion constituted by the gap which passes from the indoor side of the ceiling board to the back side of the ceiling board is provided between the outer ring and the opposing wall portion.

With such a configuration, the ventilation portion provided between the opposing wall portion and the outer ring encourages the thermal airflow generated during a fire to be discharged to the back side of the ceiling, the thermal airflow is supplied continuously to the heat-activated unit of the sprinkler head, and a swift operation of the sprinkler head can thereby be facilitated. Specifically, due to the ventilation portion provided between the opposing wall portion and the outer ring, the thermal airflow is diffused throughout a space above the ceiling, at a position away from the indoor side of the ceiling board. Thus, the thermal airflow is prevented from stagnating at the back side of the inner ring, and a temperature difference between the inner side of the ventilation portion and the outer side thereof is thereby maintained to enable continuous discharge of the thermal airflow to the back side of the ceiling.

According to an aspect of the present invention, the sprinkler head accessory can have a configuration in which the opposing wall portion on the inner ring side has a path. The sprinkler head accessory may alternatively have a configuration in which a path is provided on the outer ring side. According to an aspect of the present invention, the ventilation portion is provided between the opposing wall portion and the outer ring, and a circumferential wall portion and a tube portion thereby function as the walls of the ventilation portion. Moreover, according to an aspect of the present invention, because the ventilation portion is inconspicuous when viewed from the indoor side of the ceiling board, the sprinkler system can be configured without deteriorating a design.

According to the present invention, thermal airflow can be supplied continuously to a heat-activated unit of the sprinkler head, and a swift operation of the sprinkler head can thereby be facilitated.

1, illustrating the vicinity of a ventilation portion of a sprinkler head accessory according to a sixth modification of the first embodiment.

DESCRIPTION OF THE PREFERRED EMBODIMENTS

Hereinafter, preferred embodiments according to the present invention will be described in detail with reference to the drawings. Note that the present embodiments, which will be described below, are not intended to unreasonably limit the content of the present invention stated in the claims, and not all the constituents described in the present embodiments are essential as the solution of the present invention.

In the embodiments described below, common constituents are denoted by the same references, and overlapping descriptions in the specification will be omitted. Moreover, overlapping descriptions regarding common methods of use and functions and effects in the embodiments will also be omitted. Here, when being stated in the present specification and the claims, "first" to "sixth" are used to distinguish different constituents from one another and are not used to indicate, for example, a particular order and superiority or inferiority.

First Embodiment [FIG. 1 to FIG. 3, FIG. 7]

Figure 1:
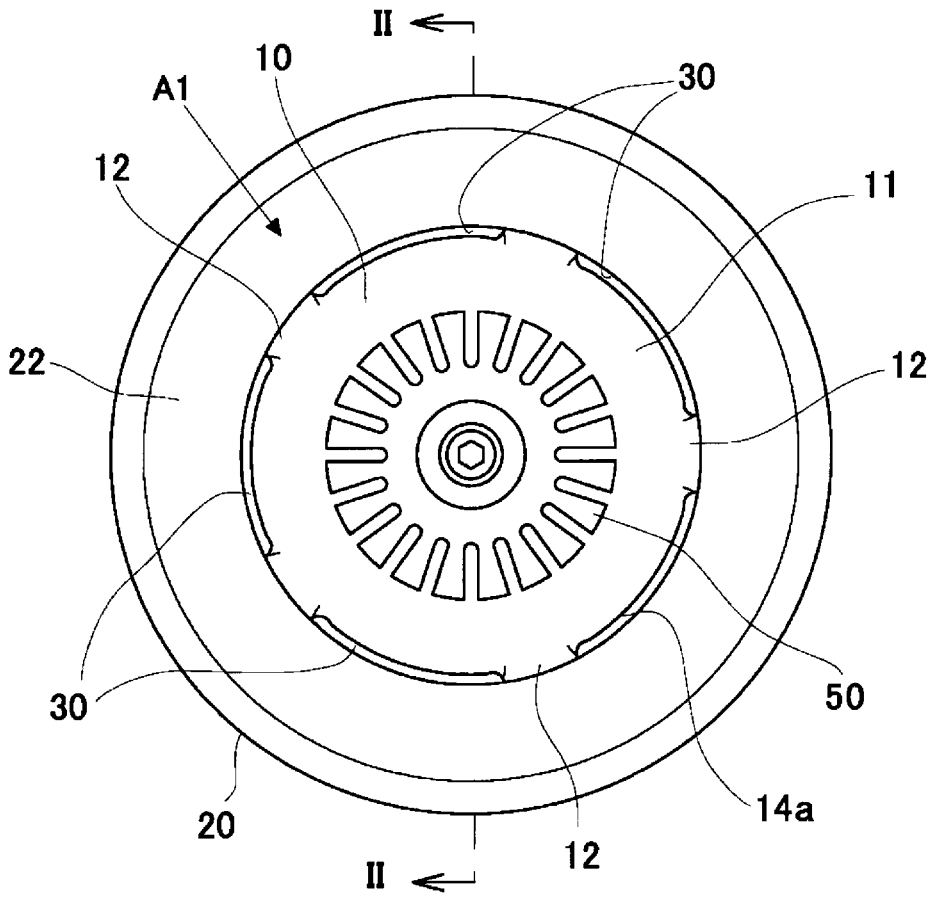
FIG. 1 is a bottom view of a sprinkler head accessory according to a first embodiment, which is installed in a ceiling board.
Figure 2:
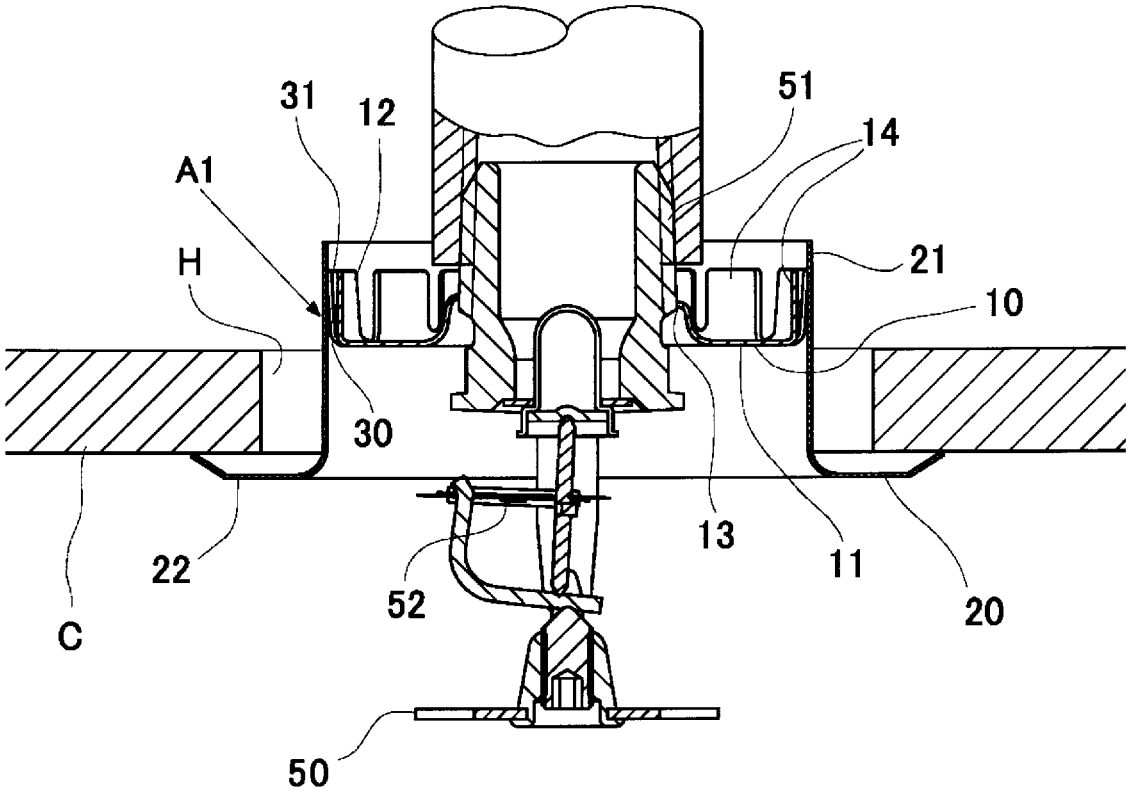
FIG. 2 is a sectional view taken along line II-II of FIG. 1.
Figure 3:
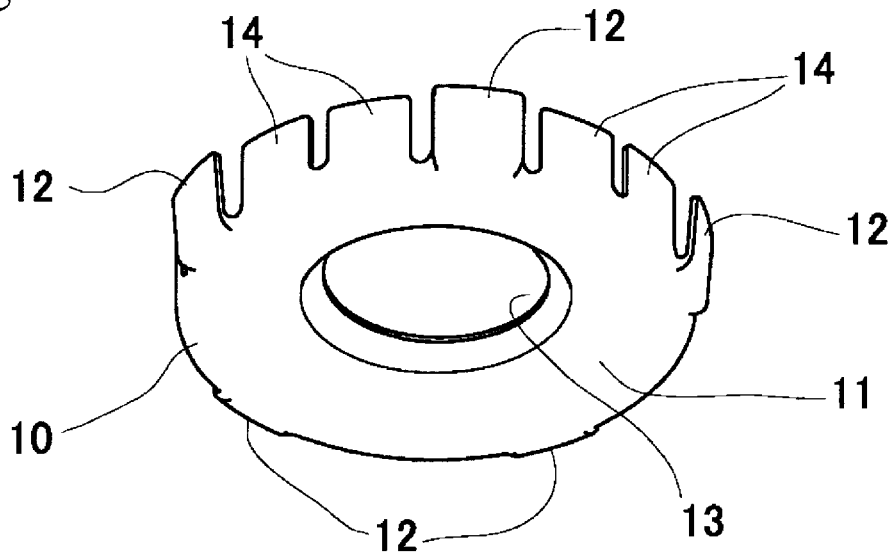
FIG. 3 is a perspective view of an inner ring illustrated in FIG. 1.

As FIGS. 1 and 2 illustrate, a sprinkler head accessory μl according to a first embodiment of the present invention is provided between a ceiling board C and a sprinkler head 50 disposed in a through hole H passing through the ceiling board C. The sprinkler head accessory μl has an inner ring 10 and an outer ring 20. The sprinkler head accessory μl is disposed so that the tube axial direction of each of the inner ring 10 and the outer ring 20 is parallel to the vertical direction in which the through hole H is formed. Each of the inner ring 10 and the outer ring 20 is made of metal and constituted by, for example, a steel plate. Alternatively, each of the inner ring 10 and the outer ring 20 may be constituted by, for example, a stainless-steel plate or a brass plate. In addition, each of the inner ring 10 and the outer ring 20 may be made of a material other than metal and may be made of, for example, plastic.

The inner ring 10 is disposed between the outer ring 20 and the sprinkler head 50. The inner ring 10 has a substantially circumferential groove shape. The inner ring 10 has a disc-shaped flat face 11 expanding in the radial direction (the horizontal direction) intersecting the tube axial direction of the inner ring 10. The inner ring 10 also has circumferential wall portions 12 as "pieces" arranged vertically on a circular outer edge of the flat face 11 in the tube axial direction of the inner ring 10 (the vertical direction). By the inner ring 10 having the circumferential wall portions 12, a distance in the tube axial direction of the inner ring 10 is ensured between the flat face 11 located at a lower end, which is an end on one side of the inner ring 10, and distal ends of the circumferential wall portions 12 located at an upper end, which is an end on the other side of the inner ring 10.

A circular hole 13 for installing the sprinkler head 50 is formed at the center, in the radial direction, of the flat face 11. The edge of the hole 13 curves inward in the radial direction from the tube axial direction of the inner ring 10 so as to extend along a thread of a pipe-connecting screw 51 of the sprinkler head 50, and the pipe-connecting screw 51 can screw into the edge of the hole 13.

Figure 7:
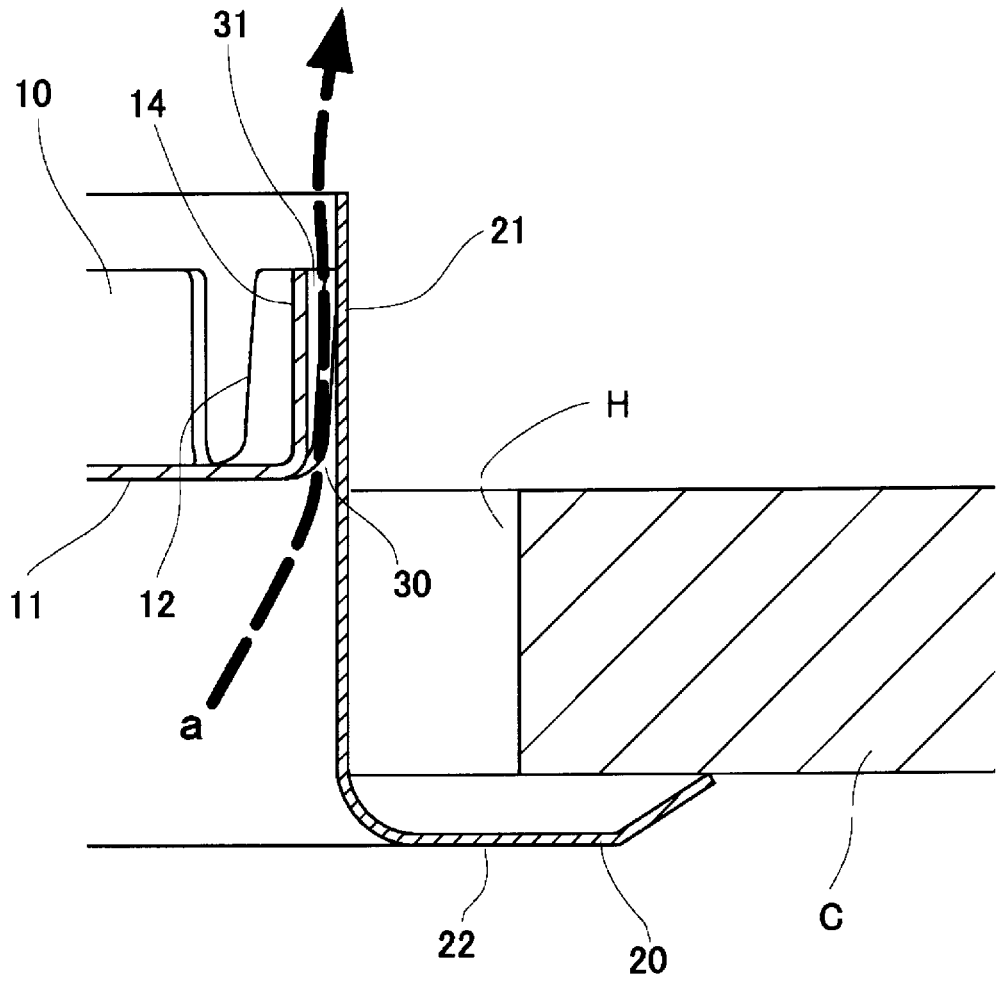
FIG. 7 is a partial magnified view of the vicinity of a ventilation portion illustrated in FIG. 2.

The circumferential wall portions 12 come into contact with a tube portion 21 of the outer ring 20 and are fitted in the inner circumference of the tube portion 21. The circumferential wall portions 12 are arranged on the outer edge of the flat face 11 at equal intervals in the circumferential direction of the inner ring 10. The circumferential wall portions 12 are provided in five places in the present embodiment. As FIG. 7 illustrates, the inner ring 10 has partition portions 14 as "opposing wall portions" facing the outer ring 20 with a gap therebetween. The partition portions 14 extend along the tube portion 21. As FIG. 1 illustrates, the partition portions 14 are arranged vertically on recessed portions **14*a* located closer to the center than the circumferential wall portions 12 in the radial direction of the circumferential wall portions 12. As FIGS. 1, 2, and 7 illustrate, between the circumferential wall portions 12 adjacent to one another in the circumferential direction thereof, the partition portions 14 rising from a corresponding one of the recessed portions 14*a* are formed away from the tube portion 21. The circumferential wall portions 12 and the partition portions 14** each have the same length in the tube axial direction thereof.

As FIG. 2 illustrates, the outer ring 20 is disposed between the inner ring 10 attached to the sprinkler head 50 and the ceiling board C. The outer ring 20 has the tube portion 21 and a dish portion 22. The tube portion 21 extends in a direction intersecting the ceiling board C (that is, the tube axial direction of the outer ring 20). As described previously, the inner ring 10 is fitted in the tube portion 21. The tube portion 21 is disposed so that the upper end thereof that is an end on the other side in the tube axial direction protrudes to the upper side relative to the upper ends of the circumferential wall portions 12. Thus, a distance in the tube axial direction of the outer ring 20 is ensured between the flat face 11 located at the lower end of the inner ring 10 and a distal end of the tube portion 21 located at the upper end of the outer ring 20. From the lower end, which is an end on one side of the tube portion 21 in the tube axial direction thereof, the dish portion 22 expands outward in the radial direction of the tube portion 21 along a ceiling surface. The dish portion 22 has an outer diameter larger than the inner diameter of the through hole H formed in the ceiling board C. The dish portion 22 has an outer edge in contact with the ceiling board C.

As FIGS. 1 and 2 illustrate, the circumferential wall portions 12 extend from the outer edge of the flat face 11 along the tube portion 21. The inner ring 10 engages with the outer ring 20 by the circumferential wall portions 12 pressing the tube portion 21. The partition portions 14, which are disposed closer to the center than the circumferential wall portions 12 in the radial direction of the inner ring 10, are away from the tube portion 21, and openings 30 are formed between the partition portions 14 and the tube portion 21. Each of the openings 30 has an arc shape extending along the outer edge of the flat face 11.

As FIGS. 2 and 7 illustrate, the sprinkler head accessory μl has, between the tube portion 21 and the partition portions 14, ventilation portions 31 constituted by respective gaps through which the indoor side of the ceiling board C and the back side of the ceiling board C communicate with one another. That is, each of the ventilation portions 31 is constituted by a gap that is formed so as to extend, from the corresponding opening 30, upward in the tube axial direction of the inner ring 10, between the tube portion 21 and the partition portions 14 rising from the corresponding recessed portion **14*a*. The ventilation portion 31 is formed by the partition portions 14 being provided adjacent to the respective circumferential wall portions 12 and is located between two circumferential wall portions 12**. The ventilation portion 31 has a section whose surface is an arc shape extending along the outer edge of the inner ring 10.

Plural ventilation portions 31 are preferably provided and more preferably provided at three to six locations. Each of the ventilation portions 31 has a length, in the tube axial direction of the tube portion 21 of the outer ring 20, more than or equal to a predetermined length. The length of the ventilation portion 31 is more than or equal to half the length of each of the circumferential wall portions 12 and can more preferably be more than or equal to the length of the circumferential wall portion 12. By the length of the ventilation portion 31 being more than or equal to half the length of the circumferential wall portion 12, an effect of separating a jetting outlet of airflow and the flat face 11 from one another is brought to the fore.

The air heated during a fire moves upward in the room and stays below the ceiling board C. At this time, because there is a temperature difference between the room in which the fire has broken out and the space above the ceiling that is separated from the room by the ceiling board C, a portion of the heated air staying below the ceiling board C flows from each of the openings 30 into the tube portion 21, passes through each of the ventilation portions 31, and is discharged to the back side of the ceiling. FIG. 7 illustrates flow a of the air that flows from the opening 30, passes through the ventilation portion 31, and is discharged to the back side of the ceiling.

Here, a distance in the tube axial direction of the sprinkler head accessory μl is ensured between the flat face 11 that is on the inlet side of the ventilation portion 31 and the distal ends of the circumferential wall portion 12 and the tube portion 21 that are on the outlet side of the ventilation portion 31. With such a configuration, by the inner ring 10 having the circumferential wall portions 12 and the partition portions 14, the air passing through each of the ventilation portions 31 hardly flows inward in the radial direction of the inner ring 10 relative to the circumferential wall portions 12 and the partition portions 14.

Thus, the air that has passed through the ventilation portion 31 is discharged and diffused at a position away from the flat face 11 of the inner ring 10, and the temperature in a space on the back side of the flat face 11 (the upper side of the flat face 11 in the tube axial direction of the inner ring 10) is thereby suppressed from rising. Accordingly, a temperature difference between the indoor side and the back side of the ceiling, with the flat face 11 of the inner ring 10 as the boundary, is maintained, and the heated air in the room flows from the opening 30, passes through the ventilation portion 31, and is discharged to an attic in a continuous manner. With the configuration according to the present embodiment, such airflow at a flow velocity developed by continuous flow can increase the proportion of a quantity of the heat transferred from the airflow to a heat-activated unit 52 of the sprinkler head 50, and a swift operation of the sprinkler head 50 can be facilitated.

In contrast, if no openings 30 are formed between the outer edge of the flat face 11 (the partition portions 14) and the tube portion 21, airflow is hardly generated near the sprinkler head 50, and heat transport due to convection of the air that has heated is hardly performed with respect to a surface of the heat-activated unit 52. Thus, in such a case, it is difficult to facilitate a swift operation of the sprinkler head 50.

On the other hand, a configuration in which the openings 30 are formed between the outer edge of the flat face 11 and the tube portion 21 but no partition portions 14 are provided can be considered. In such a case, when the air that has passed through the openings 30 is discharged to the space above the ceiling, the heated air flows into the space on the back side of the flat face 11, and the temperature difference between the indoor side and the back side of the ceiling, with the flat face 11 as the boundary, becomes smaller as time elapses. When the temperature difference between the indoor side and the back side of the ceiling, with the flat face 11 as the boundary, is smaller, the flow a of the air in the ventilation portion 31, which is caused by natural convection driven by the temperature difference, stagnates. With such stagnation, the air around the sprinkler head 50 stops moving, and heat is hardly propagated into the heat-activated unit 52, compared with the configuration, according to the present embodiment, including the partition portions 14.

In addition, when the inner ring 10 is disposed near a lower portion of the tube portion 21, that is, a position near the dish portion 22 in the tube axial direction of the inner ring 10, the depth, in the tube axial direction, of a recessed space that is on the back side of the inner ring 10 and on the inner diameter side of the tube portion 21 (the space on the back side of the flat face 11) is increased. The sprinkler head accessory μl in such a case has a structure easily causing air to stagnate in the recessed space. However, in the present embodiment, by the inner ring 10 having the partition portions 14, the ventilation portion 31 is formed between the partition portions 14 and the tube portion 21. As FIG. 7 illustrates, air passes through the ventilation portion 31 located on the opposite side of the recessed space (on the back surfaces of the partition portions 14) with the partition portions 14 therebetween. By doing so, the airflow is rectified so as to be directed upward, and an effect of encouraging the air staying in the recessed space to be drawn by the negative pressure caused by the airflow and to be discharged toward the outside of the tube portion 21 is exhibited.

Figure 4:
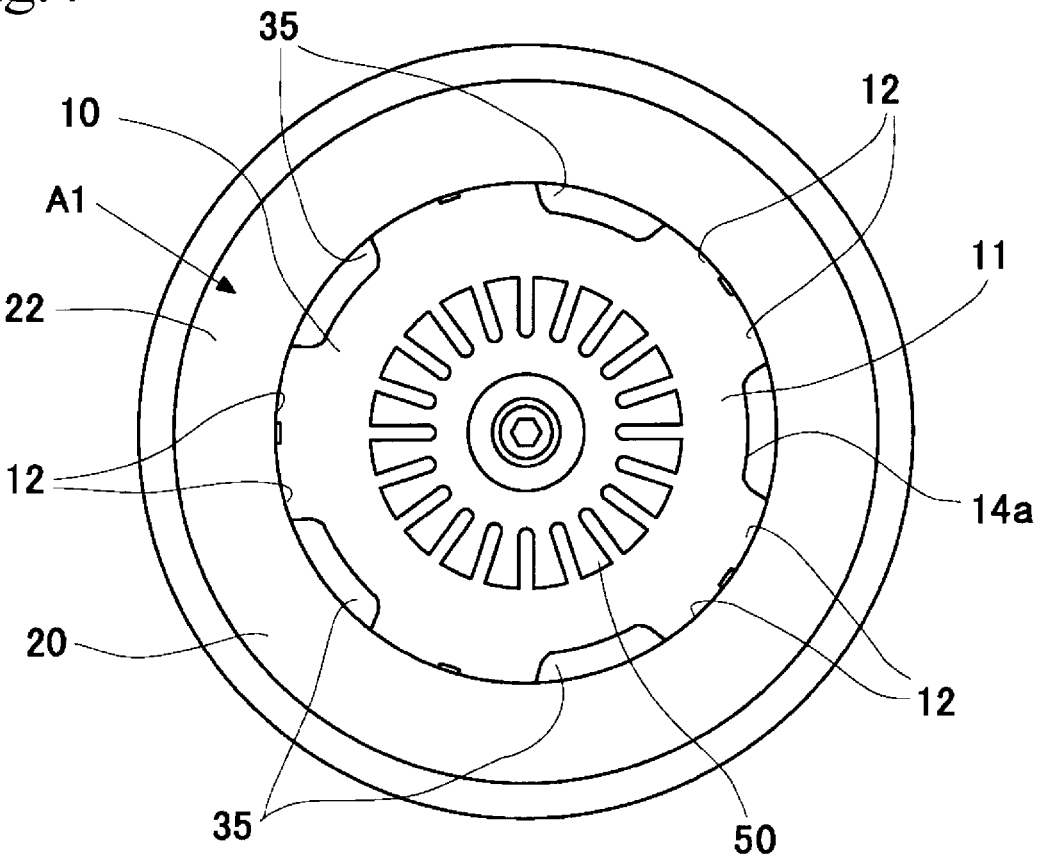
FIG. 4 is a bottom view of a first modification of the first embodiment.
Figure 5:
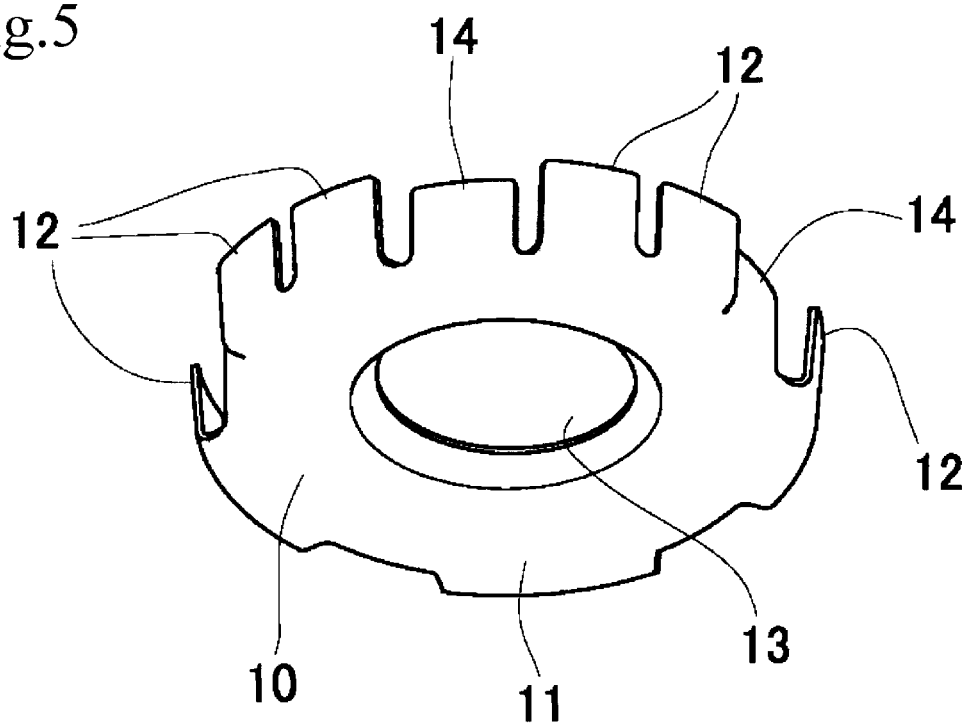
FIG. 5 is a perspective view of an inner ring illustrated in FIG. 4.
Figure 6:
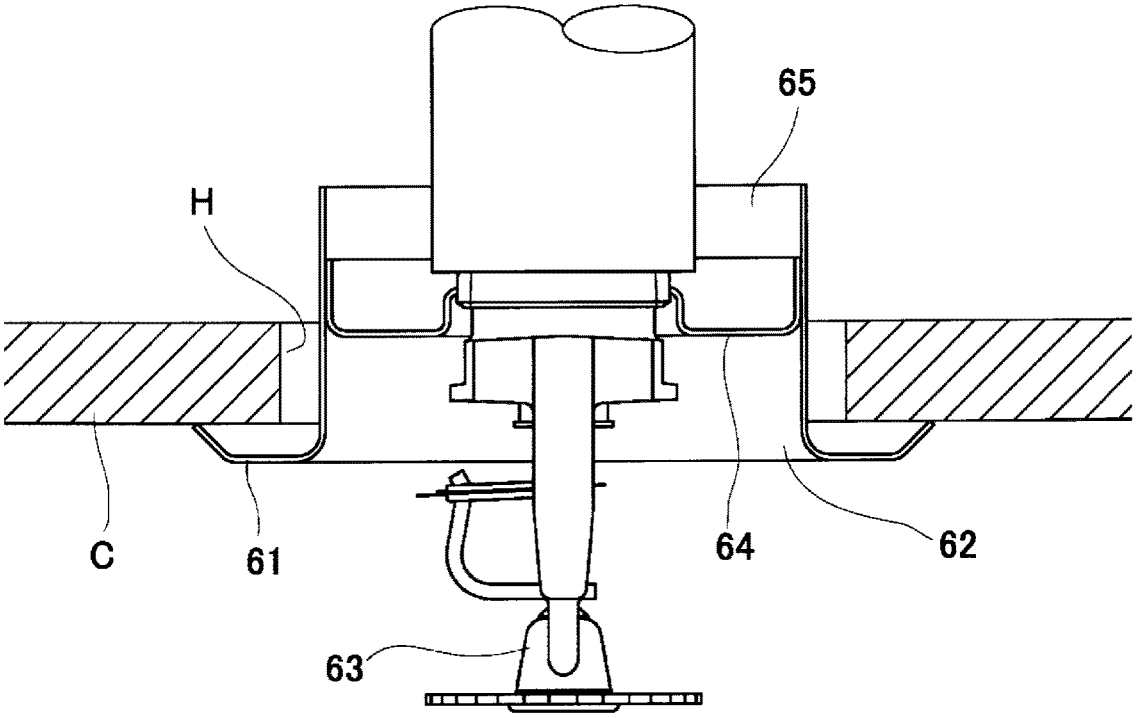
Fig.6 PRIOR ART
FIG. 6 is a sectional view of an existing sprinkler head accessory.

First Modification [FIGS. 4 and 5]

Each of the openings 30 is preferably large to some extent in view of forming continuous airflow. However, the opening 30 is preferably small and inconspicuous in view of the design of a sprinkler system. Regarding the sprinkler head accessory μl according to the present embodiment, the configuration thereof can be modified to attach the outer ring 20 to the inner ring 10 in a more stable manner.

More specifically, FIGS. 4 and 5 illustrate an example in which the engagement stability between the inner ring 10 and the outer ring 20 is focused. FIGS. 4 and 5 illustrate a first modification of the embodiment illustrated in FIGS. 1 to 3, and the same constituents are denoted by the same references, and the description thereof will be omitted. In the first modification, as FIG. 5 illustrates, each partition portion 14 is formed so that circumferential wall portions 12 are disposed on both sides of the partition portion 14. The partition portion 14 according to the first modification is disposed, in the radial direction of the inner ring 10, closer to the center than the partition portion 14 according to the above-described first embodiment. Thus, in such a configuration of the first modification, compared with the configuration of the previously described embodiment, the interval between the partition portion 14 and the tube portion 21 is wide, and an opening 35 is thereby conspicuous as FIG. 4 illustrates. However, the engagement stability with the tube portion 21 increases because, in the entire circumference of the outer edge of the flat face 11, the arc length of the opening 35 is small, and the proportion of the circumferential wall portions 12 pressing the tube portion 21 is large.

Figure 8:
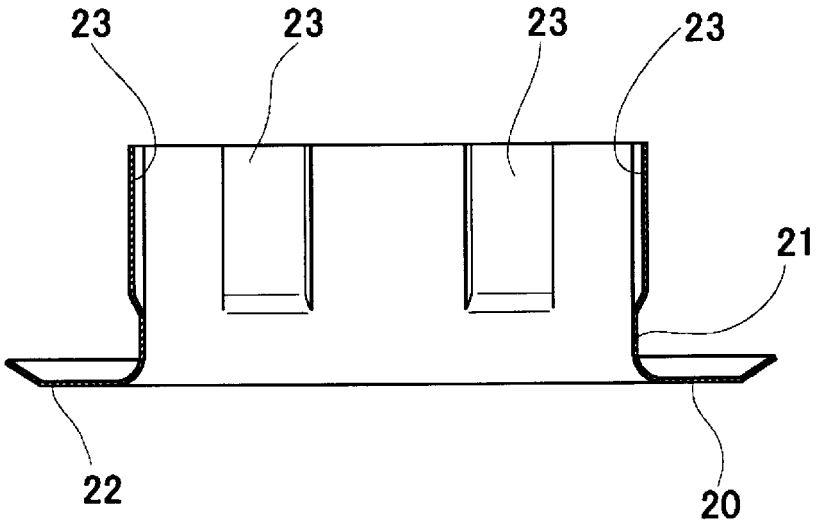
FIG. 8 is a sectional view, which is taken along a line corresponding to line II-II of FIG. 1, illustrating an outer ring according to a second modification of the first embodiment.

Second Modification [FIG. 8]

In the above-described first embodiment and first modification, the partition portions 14 as "opposing wall portions" are provided in the inner ring 10 to form the ventilation portions 31 between the partition portions 14 and the tube portion 21. However, the ventilation portions 31 can be provided in the tube portion 21. More specifically, as FIG. 8 illustrates, the ventilation portions 31 can also be formed by forming vertical grooves 23 as "grooves" in a portion of a tube portion 21. On the inner circumferential surface of the tube portion 21, each of the vertical grooves 23 is formed so as to protrude, in the form of a groove, outward in the radial direction of the outer ring 20. The vertical groove 23 has a rectangular shape having a length in the tube axial direction of the outer ring 20 more than a length thereof in the circumferential direction of the outer ring 20, and, in the tube axial direction of the outer ring 20, the vertical groove 23 has a length exceeding approximately two-thirds the length of the outer ring 20 from the upper end of outer ring 20.

Each ventilation portion 31 according to a second modification is constituted by a gap formed between an "opposing wall portion" and the vertical groove 23 formed in a region facing the "opposing wall portion". The "opposing wall portion" here may be the circumferential wall portion 12 or the partition portion 14.

In the second modification, when the "opposing wall portion" is constituted by the circumferential wall portion 12, the opening 30 between the circumferential wall portion 12 and the vertical groove 23 can be more inconspicuous because no partition portion 14 is required to be provided in the inner ring 10. Thus, the design of the sprinkler system can further be improved. Moreover, because no partition portion 14 is required to be provided in the inner ring 10, the structure of the inner ring 10 can further be simplified to enhance the versatility of the inner ring 10. Furthermore, the sprinkler system can easily be attached without positioning the inner ring 10 and the outer ring 20 in the circumferential direction.

On the other hand, when the "opposing wall portion" is constituted by the partition portion 14 in the second modification, the opening 30 and the ventilation portion 31 that are between the partition portion 14 and the vertical groove 23 can be larger to cause a larger quantity of air to flow. Thus, airflow at a flow velocity developed by continuous flow can increase the proportion of a quantity of the heat transferred from the airflow to the heat-activated unit 52 of the sprinkler head 50, and a swift operation of the sprinkler head 50 can further be facilitated.

Figure 9:
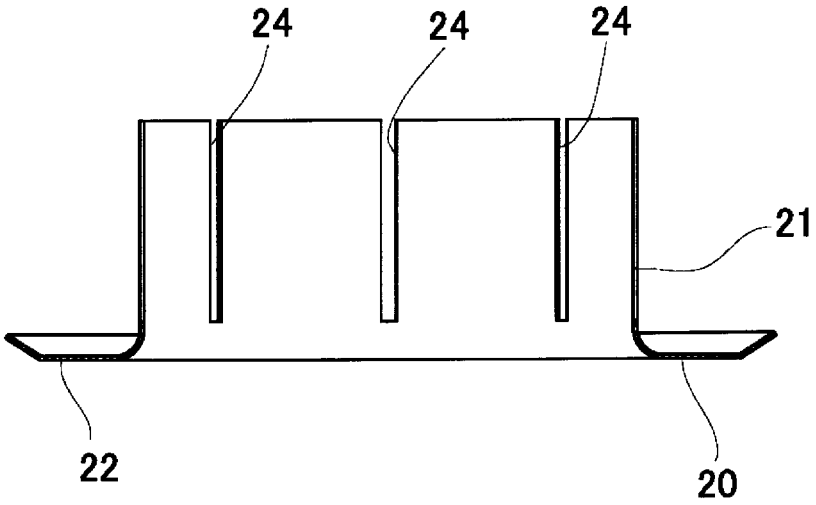
FIG. 9 is a sectional view, which is taken along a line corresponding to line II-II of FIG. 1, illustrating an outer ring according to a third modification of the first embodiment.

Third Modification [FIG. 9]

As FIG. 9 illustrates, the ventilation portions 31 can also be formed by forming narrow gaps 24 in a portion of a tube portion 21. Each of the narrow gaps 24 is formed so as to pass through the tube portion 21 in the radial direction of the outer ring 20. The narrow gap 24 has a slit shape having a length in the tube axial direction of the outer ring 20 more than a length thereof in the circumferential direction of the outer ring 20, and, in the tube axial direction of the outer ring 20, the narrow gap 24 has a length exceeding approximately five-sixths the length of the outer ring 20 from the upper end of the outer ring 20.

Each ventilation portion 31 according to a third modification is the narrow gap 24 formed in a region of the tube portion 21 facing an "opposing wall portion". The "opposing wall portion" here may be the circumferential wall portion 12 or the partition portion 14. The different functions and effects exhibited by the different constituents each serving as "opposing wall portions" are similar to those in the above-described second modification.

Regarding a sprinkler head accessory μl according to the third modification, by the narrow gaps 24 being formed in the tube portion 21, airflow can be discharged outward in the radial direction of the outer ring 20 and diffused. Thus, a temperature difference between the indoor side and the back side of the ceiling, with the flat face 11 of the inner ring 10 as the boundary, can be maintained in a more effective manner.

Figure 10:
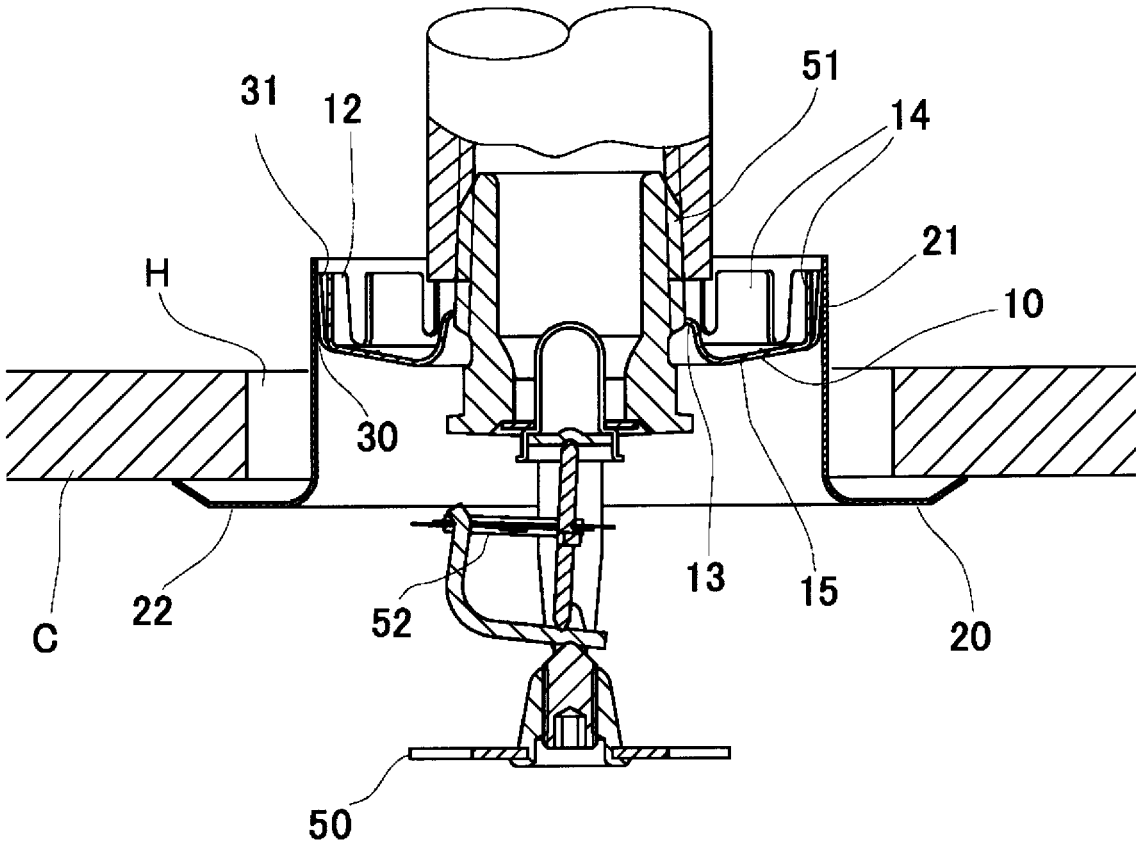
FIG. 10 is a sectional view, which is taken along a line corresponding to line II-II of FIG. 1, illustrating a sprinkler head accessory according to a fourth modification of the first embodiment.

Fourth Modification [FIG. 10]

In the above-described first embodiment, the configuration in which the flat face 11 of the inner ring 10 expands along the ceiling board C (in the radial direction of the inner ring 10 and the horizontal direction) is provided. However, the inner ring 10 can have an inclined flat face 15 inclined away from the dish portion 22 in the tube axial direction of the inner ring 10 (in the vertical direction). That is, as FIG. 10 illustrates, the inclined flat face 15 is inclined so that a portion of the inner ring 10 on the outer edge side is located on the upper side in the tube axial direction relative to a portion on the center side. Thus, the air heated during a fire is caused to flow along the inclined flat face 15 toward the outer edge. Accordingly, in a sprinkler head accessory μl according to a fourth modification, the heated air staying below the inner ring 10 can be guided to the openings 30 and to the ventilation portions 31.

Figure 11:
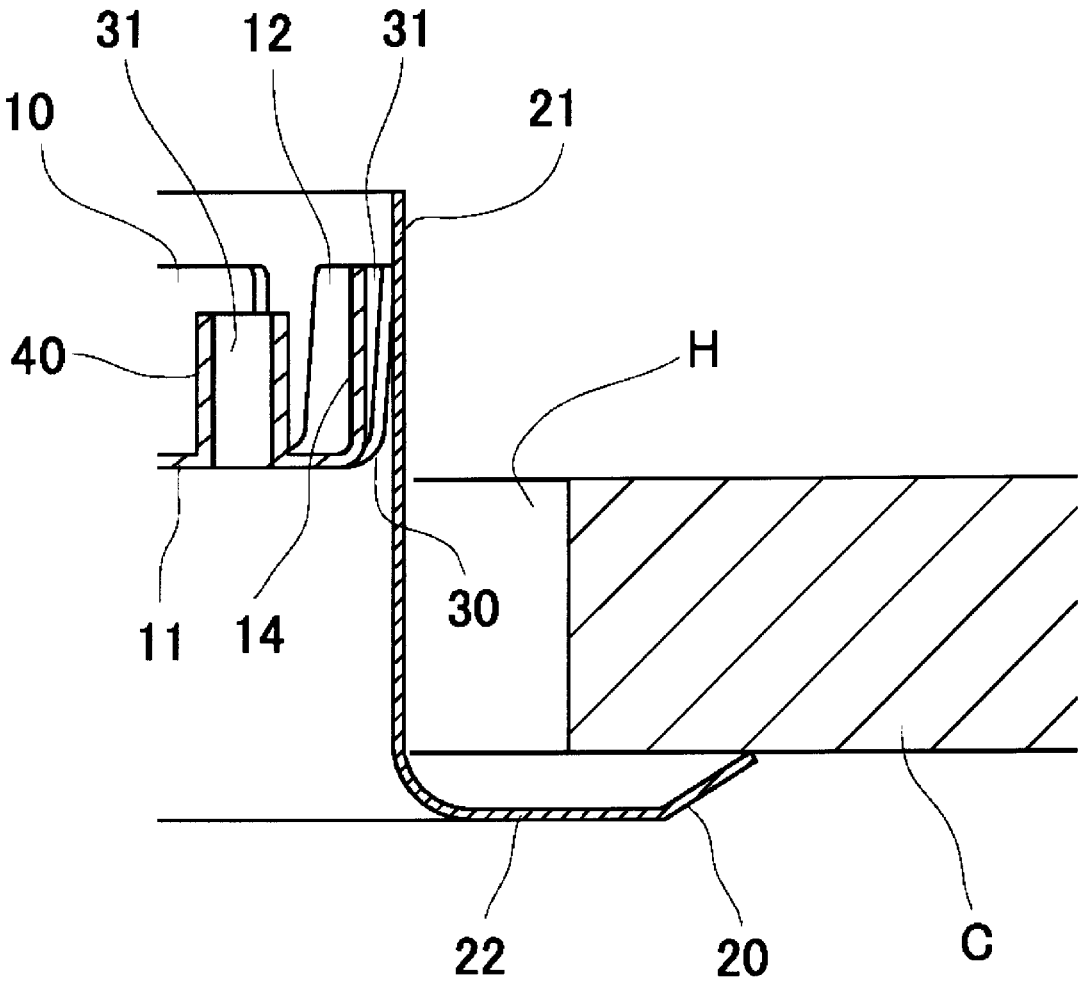
FIG. 11 is a partial enlarged view of a sectional view, which is taken along a line corresponding to line II-II of FIG. 1, illustrating the vicinity of a ventilation portion of a sprinkler head accessory according to a fifth modification of the first embodiment.

Fifth Modification [FIG. 11]

In the previously described embodiment, the partition portions 14 are formed by the edge of the flat face 11 being bent. However, the form of the inner ring 10 is not limited to such a form. As FIG. 11 illustrates, the sprinkler head accessory μl can be formed by providing a tubular body 40 in the inner ring 10 closer to the center than the opening 30 in the radial direction, and a space between the tubular body 40 and the tube portion 21 can serve as ventilation portions 31.

Figure 12:
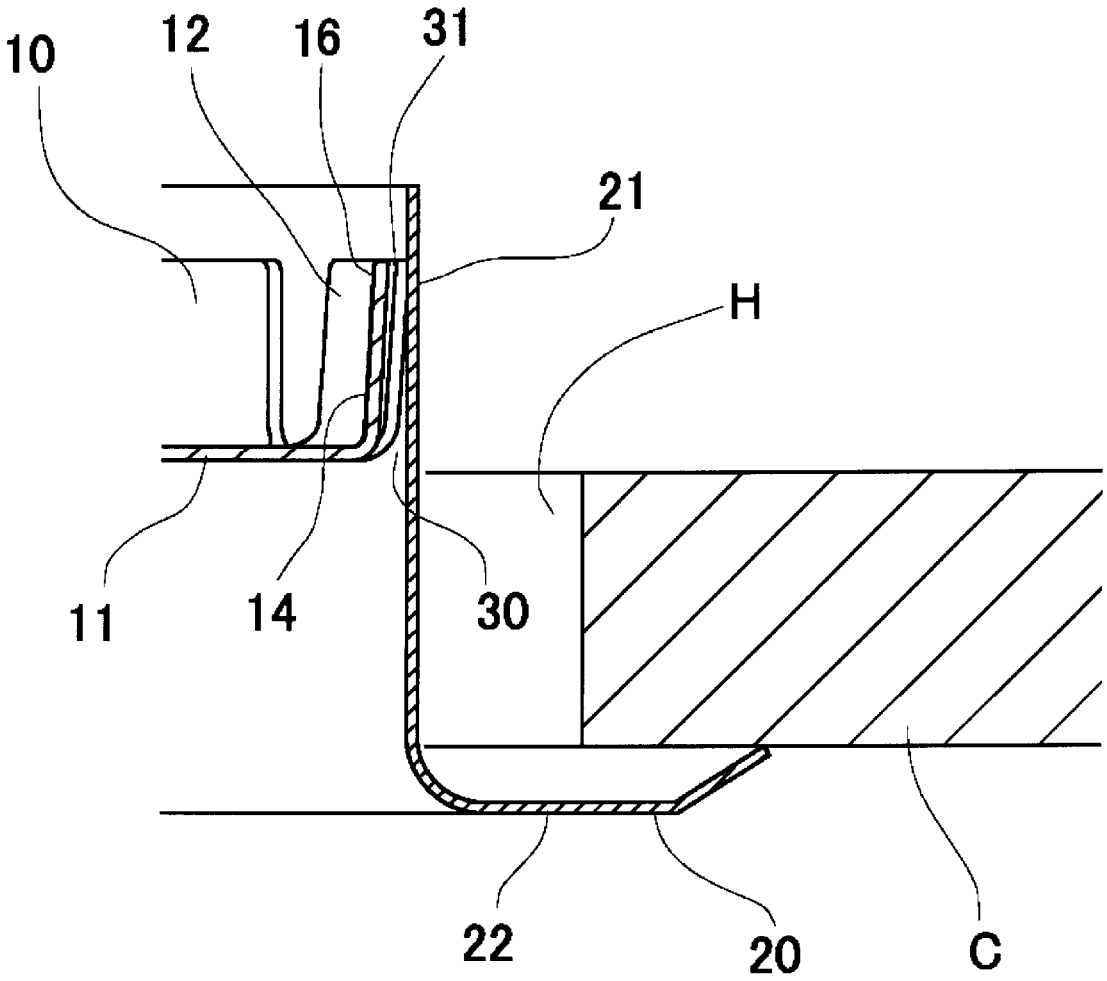
FIG. 12 is a partial enlarged view of a sectional view, which is taken along a line corresponding to line II-II of FIG.

Sixth Modification [FIG. 12]

In the embodiment illustrated in FIGS. 2 and 7, each of the partition portions 14 is provided substantially parallel to the tube portion 21. However, as FIG. 12 illustrates, the inner ring 10 can have an inclined portion 16 formed by a distal end of each partition portion 14 being inclined so as to approach the tube portion 21. By the inner ring 10 having the inclined portion 16, the airflow that has flowed from the opening 30 moves toward the tube portion 21 along the partition portion 14, and, after being discharged through the ventilation portion 31, the airflow can be discharged outside along the inner circumference of the tube portion 21.

In the embodiment illustrated in FIGS. 2 and 7, the circumferential wall portion 12 and the partition portion 14 have the same length in the tube axial direction thereof. However, the circumferential wall portion 12 and the partition portion 14 may have different lengths in the tube axial direction thereof. The partition portion 14 may be longer than the circumferential wall portion 12 in the tube axial direction thereof. By doing so, the airflow is further rectified so as to be directed upward, and an effect of further encouraging the air staying in the recessed space to be drawn by the negative pressure caused by the airflow and to be discharged toward the outside of the tube portion 21 is exhibited.

Note that, although each embodiment according to the present invention is described in detail as above, a person skilled in the art may easily understand that many modifications are possible without essentially departing from the new matters and the advantageous effects of the present invention. Thus, such modifications are all included in the scope of the present invention.

What is claimed is:

1. A sprinkler head accessory comprising:

an inner ring to which a sprinkler head is attached; and an outer ring having a tube portion in which the inner ring is arranged, wherein the inner ring has a flat face, a plurality of pieces, and an opposing wall portion, wherein the flat face has a circular hole for installing the sprinkler head, wherein the plurality of pieces is extended upwardly from an outer edge of the flat face and are in contact with an inner circumferential surface of the tube portion of the outer ring, wherein the opposing wall portion is extended upwardly from the flat face and faces an inner circumferential surface of the tube portion of the outer ring, and arranged on an outer edge of the flat face, and the plurality of pieces being in contact with the tube portion of the outer ring, wherein the inner ring is arranged between an upper end side of the tube portion and a lower end side of the tube portion, and wherein a ventilation portion passes from an indoor side of the flat face to a back side of the flat face is provided between the outer ring and the opposing wall portion.

2. The sprinkler head accessory according to claim 1, wherein the inner ring has a recessed portion formed away from the tube portion between two of the plurality of pieces, and wherein the ventilation portion is constituted by a gap formed between the opposing wall portion rising from the recessed portion and the tube portion.

3. The sprinkler head accessory according to claim 2, wherein the opposing wall portion has an inclined portion inclined so as to approach the tube portion.

4. The sprinkler head accessory according to claim 2, wherein, in the ventilation portion, a length of the tube portion of the outer ring in a tube axial direction of the tube portion is more than or equal to half a length of each of the plurality of pieces in the tube axial direction.

5. The sprinkler head accessory according to claim 1, wherein the tube portion has a groove protruding outward on the inner circumferential surface of the tube portion and wherein the ventilation portion is constituted by the gap formed between the opposing wall portion and the groove.

6. The sprinkler head accessory according to claim 1, wherein the sprinkler head accessory includes a plurality of the ventilation portions.

7. The sprinkler head accessory according to claim 1, wherein the inner ring has a circular outer edge, and wherein the ventilation portion has a section whose surface is an arc shape extending along the outer edge of the inner ring.

8. The sprinkler head accessory according to claim 1, wherein the inner ring has a plurality of pieces in contact with the outer ring, and wherein, in the inner ring, the opposing wall portion is constituted by a tubular body provided closer to a center than the pieces.

9. The sprinkler head accessory according to claim 1, wherein the ventilation portion is a slit shaped gap formed in a region of the tube portion facing the opposing wall portion.

10. The sprinkler head accessory according to claim 1, wherein the flat face is constituted by an inclined flat face inclined upward toward an outer edge of the flat face.

11. The sprinkler head accessory according to claim 1, wherein the inner ring engages with the outer ring by the plurality of pieces pressing the tube portion.

12. The sprinkler head accessory according to claim 1, wherein a tip of the sprinkler head is arranged to protrude from a lower end of the tube portion.

13. The sprinkler head accessory according to claim 1, wherein the inner ring is arranged between a position where an upper end of each of the plurality of pieces does not protrude above an upper end of the tube portion and a position where the flat face is close to a lower portion of the tube portion.

14. The sprinkler head accessory according to claim 1, wherein the inner ring is adapted to be screwed into an edge of the hole with a pipe-connecting screw of the sprinkler head.

15. The sprinkler head accessory according to claim 1, wherein the opposing wall portion is provided facing upward from a recessed portion, on the flat face, located radially closer to the circular hole than the plurality of pieces.

* * * * *